US005083483A

United States Patent [19]

Takagi

[11] Patent Number: 5,083,483

[45] Date of Patent: Jan. 28, 1992

[54] SCREW POSITIONING DEVICE

[75] Inventor: Haruo Takagi, Tokyo, Japan

[73] Assignee: Santomi Shoji Co., Ltd., Tokyo, Japan

[21] Appl. No.: 636,844

[22] Filed: Jan. 2, 1991

[51] Int. Cl.[5] ..... B25B 23/02

[52] U.S. Cl. ..... 81/434; 81/57.37

[58] Field of Search ..... 81/57.37, 434, 435; 227/120

[56] References Cited

U.S. PATENT DOCUMENTS

| | | | |
|---|---|---|---|
| 3,930,297 | 1/1976 | Potucek et al. | 81/434 X |
| 4,059,034 | 11/1977 | Hornung | 81/57.37 |
| 4,428,261 | 1/1984 | Takatsu et al. | 81/434 |
| 4,674,367 | 6/1987 | Aab et al. | 81/434 X |

*Primary Examiner*—James G. Smith

*Attorney, Agent, or Firm*—Lowe, Price, Leblanc & Becker

[57] ABSTRACT

In a screw positioning device, a slide element (5) is slidably fitted, through a return spring (10), in a slide guide case (3) which is mounted to a forward end of a screw driver tool (1), and a pin (13) is provided on the slide element (5) and is movable within an elongated bore (11) formed in the slide guide case (3) in a longitudinal direction, during the sliding movement of the slide element (5).

A transfer mechanism is provided which transfers a screw holding belt (15) by a single screw section when the slide element (5) is pushed into the slide guide case (3) part of the way. A holding mechanism is also provided which restricts return of the pin (13) to restrict return of the slide element (5).

4 Claims, 6 Drawing Sheets

SCREW POSITIONING DEVICE

BACKGROUND OF THE INVENTION

1. Field of the Invention

The present invention relates to a screw positioning device capable of continuously positioning a plurality of screws, one by one, which are planted to a screw holding belt.

2. Description of the Prior Art

A screw device is known from U.S. Pat. No. 4,059,034, in which a plurality of screws planted to a screw holding belt are driven one by one while being continuously supplied, during movement of pushing-in and returning of a driver bit with respect to an element to be screwed.

In the conventional screw device described above, transfer of the screw holding belt during pushing-in movement and screwing due to the driver bit are practiced continuously by a single movement. Accordingly, centering with respect to a screw bore formed in an element to be screwed and with respect to a screwing mark is difficult, so that disadvantages tend to occur in which the screw is screwed out of a screwing center, the screw is screwed obliquely into a screwing bore, and so on.

SUMMARY OF THE INVENTION

It is an object of the invention to provide a screw positioning device capable of correctly practicing centering of screws with respect to a screwing center to drive the screws.

In order to achieve the above-described object, a screw positioning device according to the invention comprises a slide guide case mounted to a forward end of a screw tool on which a driver bit is mounted, the slide guide case being formed with an elongated bore along a longitudinal direction, a slide element fitted in the slide guide case through a return spring for sliding movement in the longitudinal direction, the slide element having a pin fitted in the elongated bore, a transfer mechanism for transferring a screw holding belt by a single screw section during pushing-in movement of the slide element, and a holding mechanism for restricting return of the pin on the way of the pushing-in movement of the slide element after transferring of the screw holding belt.

With the above arrangement, on the way of the stroke of pushing-in movement after the screw holding belt has been transferred by the single screw section, the slide element can be retained or held within the slide guide case by the holding mechanism. Accordingly, centering of the screw with respect to the screwing center is made easy.

DETAILED DESCRIPTION OF THE PREFERRED EMBODIMENTS

Figure 1:
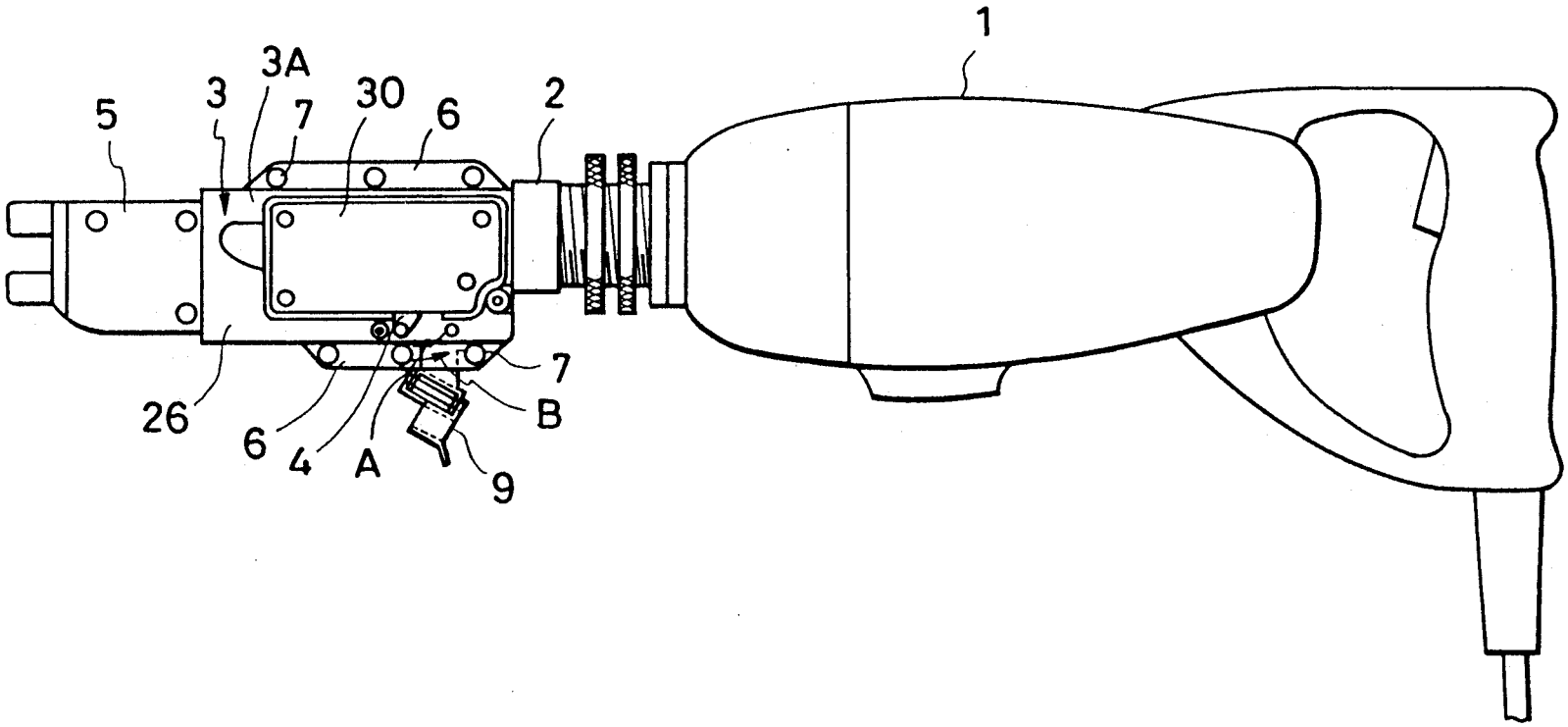
FIG. 1 is a front elevational view showing a condition in which a screw positioning device according to the invention is mounted to an electric screw driver tool.

As shown in FIG. 1, a screw positioning device is provided with a slide guide case 3 and a slide member or element 5. The screw positioning device has its proximal end which is mounted to a forward end of an electric screw driver tool 1 through a connecting member or element 2.

Figure 2:
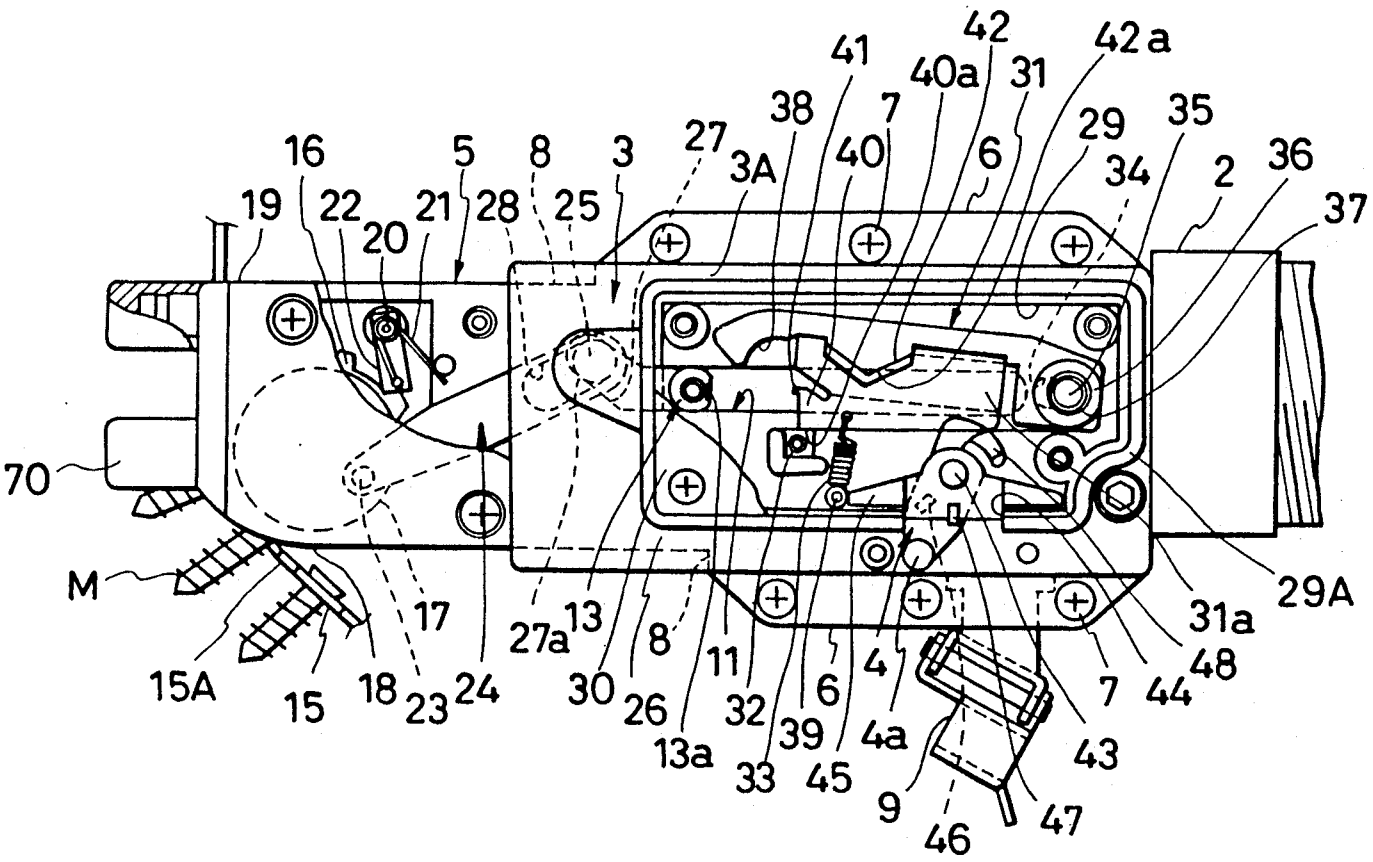
FIG. 2 is a partially cut-away front elevational view of the screw positioning device illustrated in FIG. 1.
Figure 3:
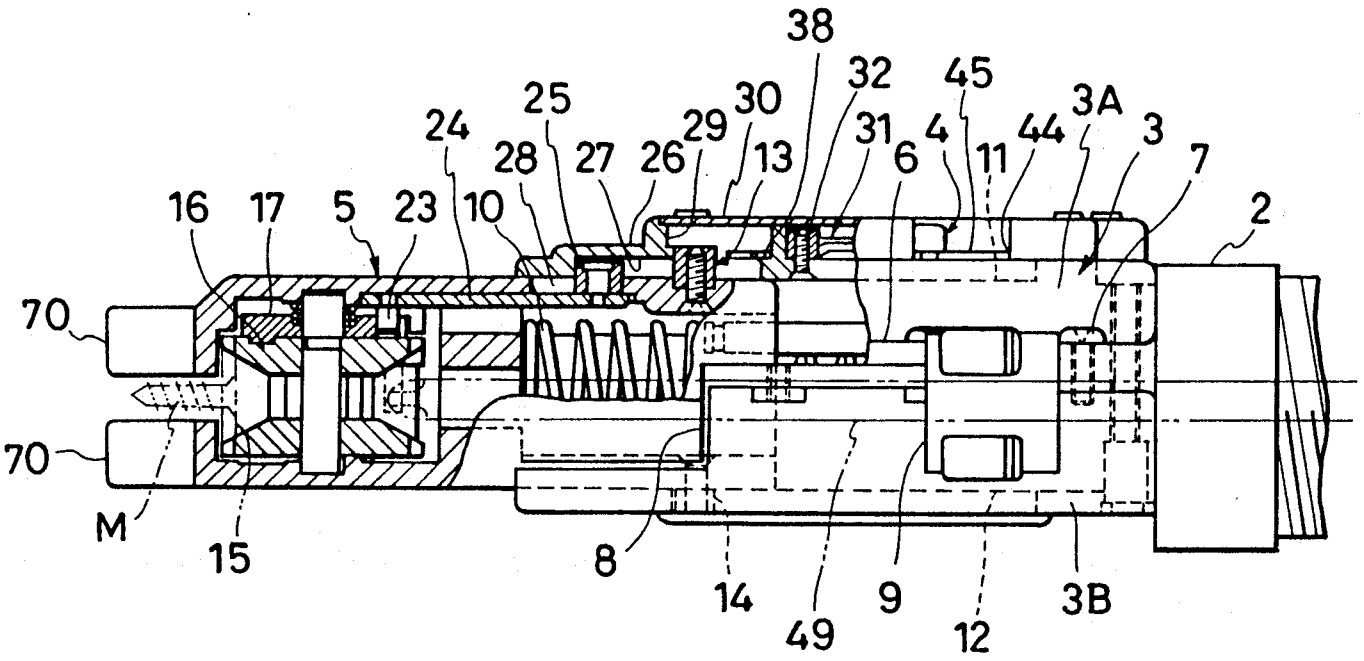
FIG. 3 is a partially broken-away top plan view of the screw positioning device illustrated in FIG. 1.

As shown in FIGS. 2 and 3, the slide guide case 3 in the form of a tube having a rectangular cross-sectional configuration is assembled such that a pair of case halves 3A and 3B have their respective front and rear face sections whose respective flanges 6 are tightened by means of screws 7. A case front face and a case rear face have their respective parts adjacent the forward end of the case 3, which are formed respectively with cut-outs 8 for relief of a band. A belt holding element 9 is mounted to a part of the case rear face of the case 3 adjacent the proximal end thereof, for enabling a screw holding belt 15 to be smoothly supplied to a belt charge section while retaining or holding the screw holding belt 15.

The slide element 5 is arranged within the slide case 3 such that the slide element 5 is fitted in the slide guide case 3 through a return spring 10 for sliding movement in a longitudinal direction. A pair of pins 13 and 14 for restriction of sliding movement, which are provided respectively on both side surface sections of the sliding element 5, are fitted respectively in a pair of elongated bores 11 and 12, which are formed in both side surface sections of the case 3 and which extend in the longitudinal direction. The sliding element 5 is slidable in the case 3 within a range of the elongated bores 11 and 12 in the longitudinal direction, while being biased by the return spring 10.

Arranged at the belt charge section within the slide element 5 are a sprocket 16 engaged with feed grooves 15A in the screw holding belt 15, to which a plurality of screws M are mounted in a single row, and a ratchet wheel 17 in mesh with the sprocket 16 only in one rotational direction. The screw holding belt 15 is supplied to the belt charge section from a belt entrance 18 arranged at the lower face section of the slide element 5, and an empty belt, from which the screws M are driven out or discharged, is discharged to the outside from a belt exit 19 which is arranged at the upper face of the slide element 5.

A stopper 22 is mounted within the slide element 5, and is biased by a spring 21 in the clockwise direction in FIG. 2 with a pin 20 serving as a fulcrum. The stopper 22 has its forward end which is abutted against one of teeth of the sprocket 16, so that the sprocket 16 is prevented from being rotated in the counterclockwise direction. By doing so, the sprocket 16 is freely rotated in the feed-out direction of the screw holding belt 15, so that the screw holding belt 15 can freely be drawn out. However, the screw holding belt 15 is blocked by the stopper 22 so that the screw holding belt 15 cannot be returned or pulled back in the reverse direction.

A pin 23 is provided on an upper face section of the ratchet wheel 17 at a location adjacent the outer periphery thereof. A lever 24 is mounted to the pin 23 for angular movement, for rotating the ratchet wheel 17 at pushing-in movement of the slide element 5. A pin 25 provided on the other end of the lever 24 is loosely fitted in an angular-movement guide groove 27 which is formed in a rear side of a side face plate 26 arranged at the forward end of the case halve 3A. The angular-movement guide groove 27 formed obliquely has its proximal end which communicates with the forward end of the elongated bore 11. In this connection, the reference numeral 28 denotes an angular-movement guide bore which is formed in the slide element 5. The pin 23 is located rearwardly with respect to the center of the ratchet wheel 17, and the angular-movement guide groove 27 is formed at the upper location with respect to the ratchet wheel 17. Accordingly, when the slide element 5 is pushed into the case 3, the pin 25 at the loose end of the lever 24 is pushed down toward the proximal-end of the case 3 along an inclined section 27*a* of the angular-movement guide groove 27. By movement resistance of the pin 25 due to the inclined section 27*a*, the ratchet wheel 17 is pushed down by the lever 24 and is rotated in the clockwise direction, and the sprocket 16 in mesh with the ratchet wheel 17 is rotated such that the screw holding belt 15 is transferred by a single screw section.

The pin 25 at the loose end of the lever 24, which has passed through the angular-movement guide groove 27, is moved toward the proximal-end of the case 3 along the elongated bore 11 when the slide element 5 is further pushed into the case 3. Accordingly, at this time, the ratchet wheel 17 is not rotated. When the slide element 5 is pushed back into the case 3 so that the pin 25 again passes through the angular-movement guide groove 27, the ratchet wheel 17 is rotated in the counterclockwise direction, and is returned to a waiting condition. At this time, the ratchet wheel 17 and the sprocket 16 are disengaged from each other. Thus, the sprocket 16 is not rotated.

A holding mechanism will be described, in which, on the way of a stroke of pushing-in movement after the slide element 5 has been pushed into the slide guide case 3 so that the screw holding belt 15 has been transferred only by the single screw section, the slide element 5 is temporarily retained or held within the slide guide case 3.

The holding mechanism is arranged within an accommodating chamber 29 which is formed in the case halve 3A.

The holding mechanism is generally composed of a hook lever 31 to which the pin 13 is hooked or latched on the way of the stroke of pushing-in movement, a stopper 32 for retaining the hook lever 31 in an unlatching position, a coil spring 33 for giving an angular-movement biasing force in a latching direction, to the hook lever 31, and a switching lever 4.

The hook lever 31 has its proximal end which is formed with an elongated bore 34 in the longitudinal direction. The elongated bore 34 is fitted about a pivot shaft 35 which is provided in spaced relation to the proximal end of the slide guide elongated bore 11 formed in the case halve 3A. By doing so, the hook lever 31 is mounted to the pivot shaft 35 for angular movement thereabout and for sliding movement in the longitudinal direction. A spiral spring 37 is fitted about the pivot shaft 35 through a washer 36. The spiral spring 37 is pushed by a rear face of a front cover 30, whereby the hook lever 31 is always urged against the side face plate 26 of the case halve 3A.

The hook lever 31 has its forward end which is formed with a hook section 38 for latching the pin 13. A portion of the hook lever 31 adjacent the elongated bore 11 is provided with a planar section 31*a* at a location shifted or deviated from the sliding movement path of the pin 13. The stopper 32, which is rectangualr in configuration in plan, is provided at a location below the elongated bore 11. The coil spring 33 is arranged between the hook lever 31 and a pin 39 provided at a location below the stopper 32, for pushing the hook lever 31 downwardly to give an angular-movement biasing force in the direction toward the stopper 32, to the hook lever 31. Under the waiting condition, a lower wall 40*a* of an abutment 40 on the hook lever 31 is pulled or tensioned by the coil spring 33 and is abutted against the stopper 32. At this time, the hook section 38 is in a position out of the elongated bore 11.

The holding mechanism comprises a slide restricting mechanism for restricting excessive pushing-in of the slide element 5. The slide restricting mechanism is composed of a pawl 41 provided in the lower end of the abutment 40 at a location positioned centrally of the elongated bore 11 under the waiting condition, and a groove 13*a* formed in the deep portion of the pin 13. A distance between the forward end of the pawl 41 and the hook section 38 is made slightly larger than the diameter of the pin 13. At pushing-in movement of the slide element 5, the pawl 41 is engaged with the groove 13*a*.

Figure 4:
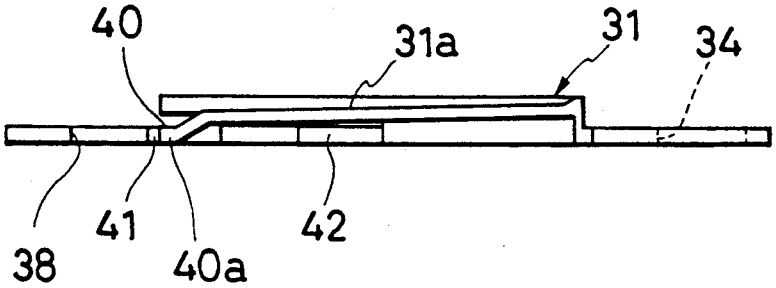
FIG. 4 is a top plan view of a hook lever which is employed in the screw positioning device illustrated in FIG. 1.

At a substantially central section of the hook lever 31, a projection 42, which has its triangular configuration in plan for returning the hook lever 31 moved angularly to the latching position of the pin 13, to the waiting condition, is formed facing toward the elongated bore 11 in parallel relation to the planar plate section 31*a* as shown in FIG. 4, so as to be located on the sliding movement path of the pin 13.

Figure 5:
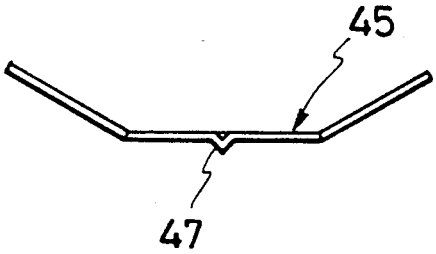
FIG. 5 is a top plan view of a leaf spring for retaining a switching lever, which is used in the screw positioning device illustrated in FIG. 1.

At a location deeper than the stopper 32, the switching lever 4 angularly moved about a pin 43 is arranged on the lateral side of the elongated bore 11. The switching lever 4 has an operating section 4*a* which projects to the outside from a cut-out 44 formed in a peripheral wall 29A of the accommodating chamber 29. The switching lever 4 is always urged against the face of the side plate 26 by a leaf spring 45 which is fitted in the cut-out 44 and whose upper and lower ends are abutted against the rear face of the front cover 30. As shown in FIG. 5, a projection 47, which is fitted in a pair of positioning bores 46 and 46 located adjacent the lever 4 to position the same to the switching position, projects from the central section of the leaf spring 45 on the rear face side thereof.

Figure 6:
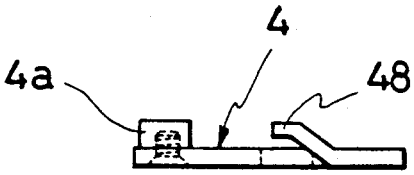
FIG. 6 is a top plan view of the switching lever which is employed in the screw positioning device illustrated in FIG. 1.

As shown in FIG. 6, the projecting end of the switching lever 4, adjacent the elongated bore 11, is formed with a key-like step 48 which, when the lever 4 is moved angularly in the direction indicated by the arrow B in FIG. 1, gets into the lower face side of the planar section 31*a* of the hook lever 31 to lift up the same to a position where there is no hindrance to passage of the pin 13.

The operation of the screw positioning device will be described.

Figure 7:
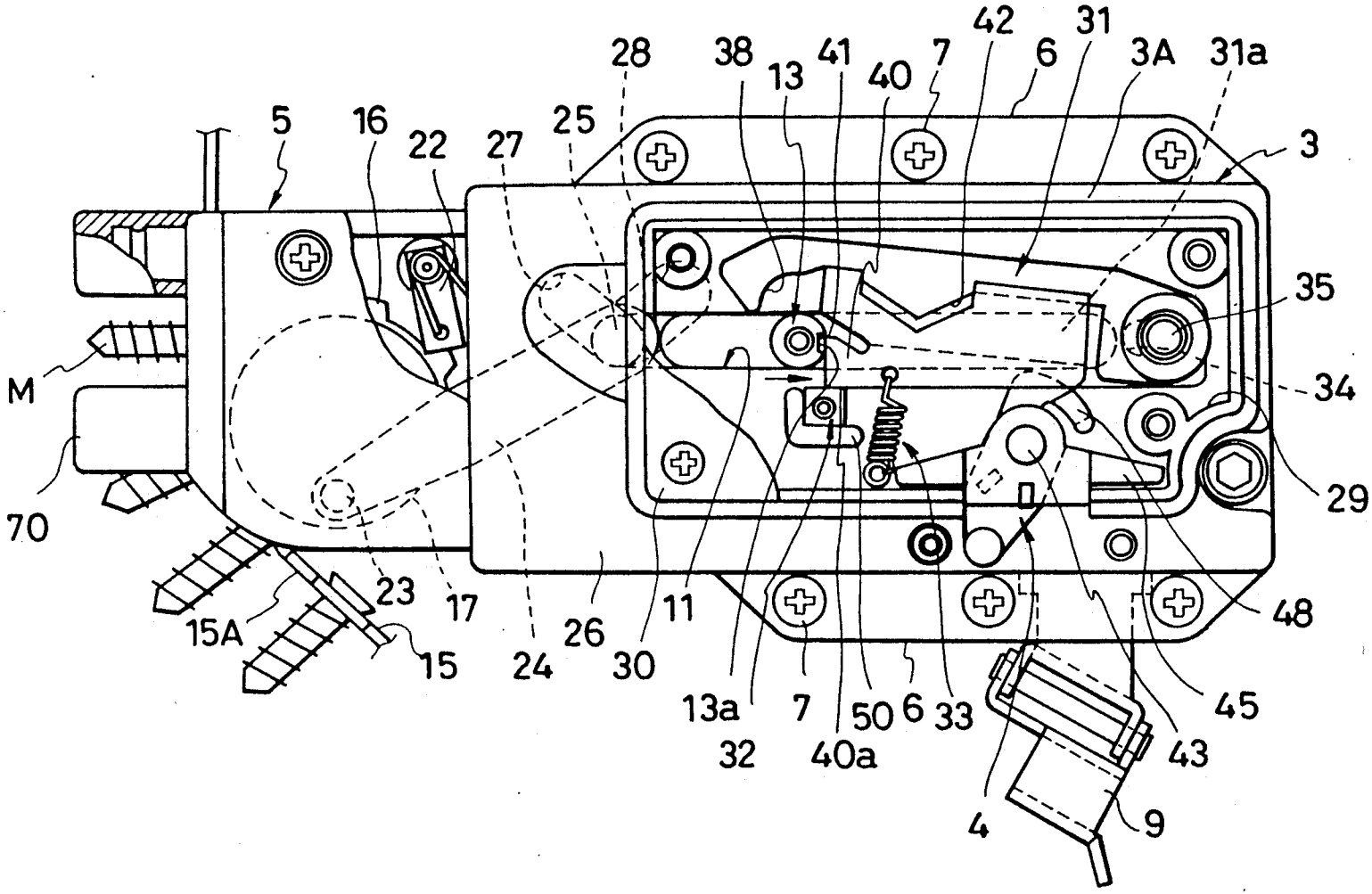
FIG. 7 is a partially cut-away front elevational view of the screw positioning device illustrated in FIG. 1, showing a condition in which a pin for restriction of sliding movement is engaged with a pawl of the hook lever.
Figure 8:
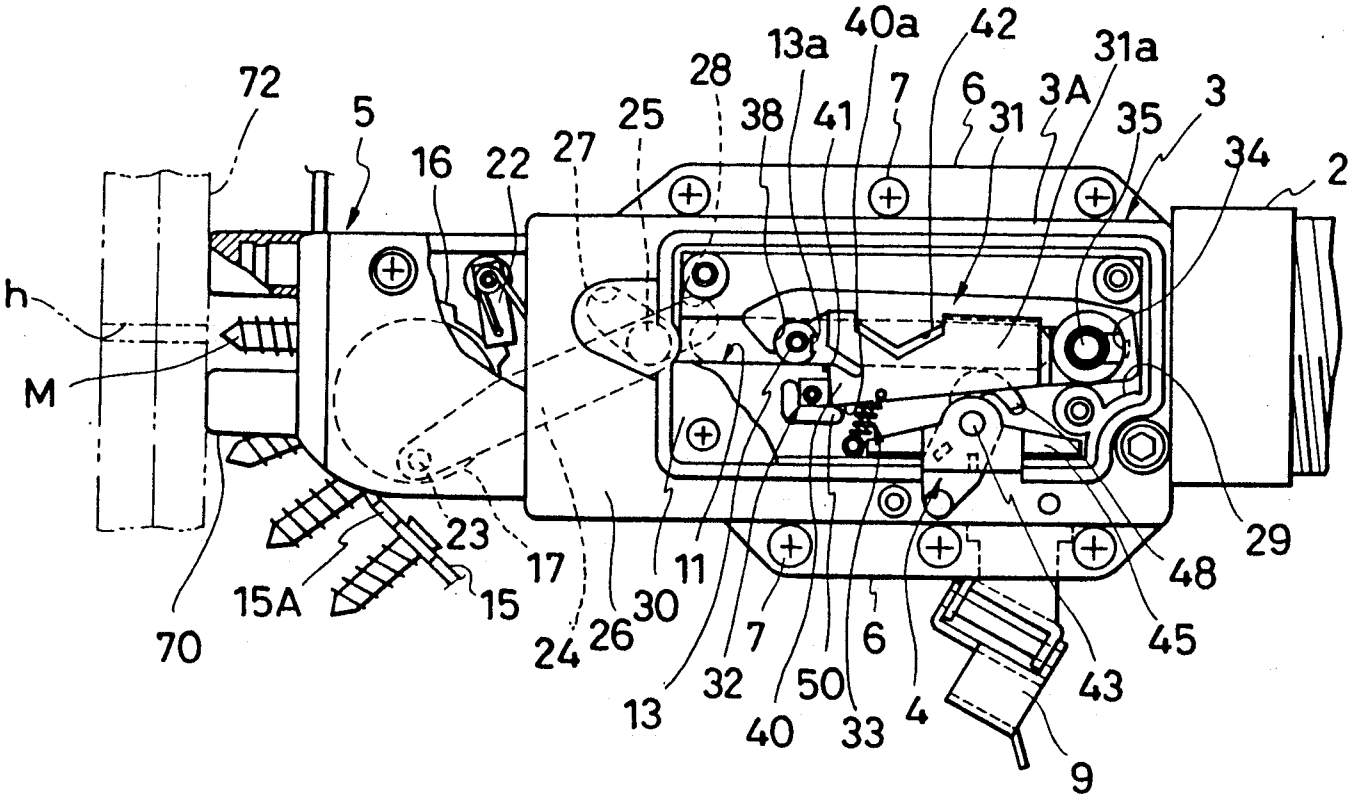
FIG. 8 is a partially cut-away front elevational view of the screw positioning device illustrated in FIG. 1, showing a condition in which the pin for restriction of sliding movement is hooked or latched to the hook lever.

First, under the condition that the switching lever 4 is moved angularly in the direction indicated by the arrow A in FIG. 1 so that the switching lever 4 is switched, the sprocket 16 is rotated with the above-described movement when the slide element 5 is pushed into the slide guide case 3. The screw holding belt 15 is fed out by the single screw section, and the screw M is transferred to the forward end of the driver bit 49, so that the screw M is located between a pair of legs 70 and 70. At this time, when the slide element 5 is further pushed into the case 3, the pawl 41 is engaged with the groove 13*a* in the pin 13 as shown in FIG. 7. Thus, the hook lever 31 is moved toward the proximal end of the case 3 in the longitudinal direction, and the hook lever 31 is moved while the elongated bore 34 is guided by the pivot shaft 35. With this movement, the hook lever 31 is disengaged from the stopper 32. When the pushing-in movement stops here, the slide element 5 is returned by the return spring 10. Thus, the pawl 41 and the groove 13*a* are disengaged from each other, so that the hook lever 31 is drawn or pulled by the coil spring 33 and is moved angularly in the counterclockwise direction until the hook lever 31 is abutted against a stopper piece 50. During the angular movement, since the hook section 38 is moved toward the forward end of the sliding movement path of the pin 13, the hook section 38 is pushed back by the return spring 10. Thus, as shown in FIG. 8, the pin 13 is latched to the hook section 38, so that the slide element 5 is held within the case 3 on the way of the stroke of return movement after transfer of the screw. Under this condition, it is possible to easily center the slide element 5 with respect to a threaded bore h formed in an element 72 to be screwed, and with respect to a mark at the screwing position. Thus, the slide element 5 is further pushed into the case 3 after the centering, whereby the screw M at the forward end of the driver bit 49 can correctly be screwed into the element 72 to be screwed, by the driver tool 1.

When a tapered section 42*a* of the projection 42 on the hook lever 31 is pushed by the pin 13 due to the pushing-in of the slide element 5 into the case guide so that the hook lever 31 is moved angularly in the clockwise direction in FIG. 8 to a position above the stopper 32, the coil spring 33 moves the hook lever 31 downwardly toward the forward end of the case 3. Thus, the lower face of the hook lever 31 is again abutted against the upper face of the stopper 32 and is returned to the waiting condition.

Further, if the switching lever 4 is switched in the direction indicated by the arrow B in FIG. 1, the hook lever 31 is pushed upwardly to a location above the elongated bore 11, and the pin 13 passes through a location below the hook lever 31. Accordingly, similarly to the conventional screw driving device, the pushing-in movement of the slide element 5 is practiced, so that transfer of the screws M and driving of the screw M are done continuously.

In connection with the above, the groove 13*a* in the pin 13 and the pawl 41 of the hook lever 31 are not necessarily required. In this case, however, there is a fear that the slide element 5 is often pushed beyond an adequate location, the driver bit 49 flies out so that the screws M project, and the element 72 to be driven is damaged at the positioning. Accordingly, sufficient attention must be made to allowance of a force at pushing-in.

What is claimed is:

1. A screw positioning device comprising a slide guide case mounted to a forward end of a screw tool on which a driver bit is mounted, said slide guide case being formed with an elongated bore along a longitudinal direction, a slide element fitted in said slide guide case through a return spring for sliding movement in the longitudinal direction, said slide element having a pin fitted in said elongated bore, a transfer mechanism for transferring a screw holding belt by a single screw section during pushing-in movement of said slide element, and a holding mechanism for restricting return of said pin on the way of the pushing-in movement of said slide element after transferring of said screw holding belt.

2. The screw positioning device according to claim 1, wherein said holding mechanism is provided with a switching mechanism which is switched between an operating condition and a release condition.

3. The screw positioning device according to claim 1, wherein said holding mechanism comprises a hook lever movable angularly between a position closing said elongated bore and a position out of said elongated bore, said hook lever being supported for sliding movement along the longitudinal direction during sliding movement of said pin, said hook lever being engaged with said pin when said hook lever is moved angularly toward said elongated bore, to restrict return movement of said pin, a spring biasing said hook lever toward a forward end of said slide guide case and in such a direction that a hook section of said hook lever is engaged with said pin, a stopper for restricting angular movement of said hook lever in such a direction that said hook section is engaged with said pin when said hook lever is located facing toward the forward end of said slide guide case, and an inclined projection mounted to said hook lever, said projection being abutted against said pin passing through a location closer to a proximal end of said slide guide case in the longitudinal direction than said restricting position, to push said hook lever to a location where said section is out of said pin.

4. The screw positioning device according to claim 1, wherein said transfer mechanism comprises a sprocket in mesh with a plurality of feed grooves in said screw holding belt, a ratchet wheel in mesh with said sprocket only in one rotational direction, and a lever having one end thereof engaged with said ratchet wheel, the other end of said lever being latched to said slide element, said lever rotating said ratchet wheel in a transfer direction of said screw holding belt during pushing-in movement of said slide element.

* * * * *